US005674028A

United States Patent [19]

Norin

[11] Patent Number: 5,674,028

[45] Date of Patent: Oct. 7, 1997

[54] DOWELED CONSTRUCTION JOINT AND METHOD OF FORMING SAME

[76] Inventor: Kenton Neal Norin, R.R. 1, Box 90, Centerville, S. Dak. 57014

[21] Appl. No.: 508,910

[22] Filed: Jul. 28, 1995

[51] Int. Cl.[6] ..... E01C 11/14

[52] U.S. Cl. ..... 404/74; 404/60; 404/63

[58] Field of Search ..... 404/47, 56, 59, 404/60, 62, 63, 74, 70, 72, 88; 14/73.1; 52/396.02, 704, 677

[56] References Cited

U.S. PATENT DOCUMENTS

| | | | |
|---|---|---|---|
| 1,545,267 | 7/1925 | Marye . | |
| 1,752,327 | 4/1930 | Briody . | |
| 1,755,219 | 4/1930 | Knox . | |
| 1,918,554 | 7/1933 | Older . | |
| 1,942,494 | 1/1934 | Robertson . | |
| 2,031,901 | 2/1936 | Mitchell . | |
| 2,149,291 | 3/1939 | Hofwolt . | |
| 2,164,590 | 7/1939 | Oates . | |
| 2,192,571 | 3/1940 | Bitney . | |
| 2,224,194 | 12/1940 | Mitchell | 404/88 |
| 2,308,677 | 1/1943 | Dailey . | |
| 2,316,233 | 4/1943 | Fischer . | |
| 2,365,550 | 12/1944 | Heltzel . | |
| 2,500,262 | 3/1950 | Parrott . | |
| 2,521,643 | 9/1950 | Mathers . | |
| 2,531,040 | 11/1950 | Heltzel . | |
| 3,329,072 | 7/1967 | Rice . | |
| 3,397,626 | 8/1968 | Kornick et al. . | |
| 3,437,017 | 4/1969 | Walz et al. . | |
| 3,559,541 | 2/1971 | Walstein . | |
| 3,881,833 | 5/1975 | McMullen . | |
| 4,353,666 | 10/1982 | Brandley . | |
| 4,433,936 | 2/1984 | Moser . | |
| 4,449,844 | 5/1984 | Larsen . | |
| 4,493,584 | 1/1985 | Guntert . | |
| 4,648,739 | 3/1987 | Thomsen . | |
| 4,688,963 | 8/1987 | Ritchey et al. . | |
| 5,005,331 | 4/1991 | Shaw et al. | 52/396.02 |
| 5,051,024 | 9/1991 | Warthmann . | |
| 5,190,397 | 3/1993 | Bengford et al. | 404/72 X |
| 5,216,862 | 6/1993 | Shaw et al. | 52/704 X |

FOREIGN PATENT DOCUMENTS

| | | | |
|---|---|---|---|
| 2185046 | 7/1987 | United Kingdom | 404/63 |

*Primary Examiner*—James Lisehora

*Attorney, Agent, or Firm*—Patent & Trademark Services; Joseph H. McGlynn

[57] ABSTRACT

In the construction of a concrete surface formed by a plurality of slabs, sleeves are inserted into a slab while the concrete is still plastic. The slab is allowed to harden. Dowel bars are then inserted into the sleeves to provide load distribution among the slabs. Advantageously, the dowel bars are inserted into a slab only when construction of adjacent slabs is ready to proceed.

8 Claims, 1 Drawing Sheet

DOWELED CONSTRUCTION JOINT AND METHOD OF FORMING SAME

BACKGROUND OF THE INVENTION

This invention relates in general to the construction of a concrete surface formed by a plurality of separate slabs, and in particular to the construction of a concrete surface formed by a plurality of separate slabs having a reinforced doweled joint between the separate slabs.

DESCRIPTION OF THE PRIOR ART

In the prior art doweled joints between adjacent concrete slabs have been known. However, the dowels have been inserted in at least one of the slabs while the concrete is still in a plastic state or the dowels have been inserted into the slabs after the concrete has set. Usually this is accomplished by drilling a hole in the concrete and then inserting a dowel with the end coated with an epoxy. Both methods have serious drawbacks. For example if the dowel is inserted while the concrete is still plastic the dowel, being heavier than the wet concrete tends to sink and when the concrete sets the dowel is out of alignment. If the dowel is inserted into the set concrete by drilling, the drilling operation causes voids to appear in the concrete. The voids will cause a loose joint between the dowel and the concrete slab.

SUMMARY OF THE INVENTION

Concrete surfaces such as aircraft landing strips, taxi ways, parking aprons and shipyards typically require an area large enough to allow movement of heavy loads and strong enough to withstand impacts from such loads. For example, an aircraft landing strip must be long enough to allow the landing and taxiing of aircraft. It is therefore not uncommon for a landing strip to have a length of more than two miles and a width of more than two hundred feet.

Because of their lengths, these surfaces are typically formed by a plurality of slabs disposed lengthwise with a spacing provided in-between for thermal expansion and contraction. However, when a slab in such a surface is impacted by a heavy load, such as when a large jet aircraft lands, one end of the slab will tend to sink, which will raise the other end of the slab relative to the adjacent slabs, creating a height differential along the boundary between adjacent slabs that can cause damage to both the aircraft and the slabs. A runway which is subject to constant upward and downward movement soon develops flaws in the concrete which ultimately means the runway must be replaced at great expense.

The present invention is designed to prevent problems, as detailed above, from occurring. In the present invention dowel bars, typically made of steel, are used to distribute vertically applied loads to the adjacent concrete slabs, thereby eliminating the height differential between slabs. A surface constructed in this manner is sometimes referred to as a doweled concrete surface.

The present invention is related to the construction of a doweled concrete surface. The invention is directed to a concrete slab which comprises a top surface forming a portion of the concrete surface, such as an aircraft runway, and side surfaces perpendicular to the top surface. The side surfaces which face an adjacent slab are provided with a plurality of non-metallic sleeves inserted into the concrete slab through the side surface while the concrete is in a plastic condition. Each of the sleeves provides a hole at the side surface for slidably receiving a dowel bar. Since the holes were not formed by drilling after the concrete has set, there will be no voids formed which will shorten the life of the slab. Each of the sleeves further has a predetermined length to provide room for expansion of the dowel bar.

The present invention is also related to a method for constructing a concrete surface. The method comprises the steps of forming a first concrete slab, inserting a plurality of sleeves through a side surface of the first slab while the concrete is in a plastic state, allowing the concrete of the first slab to cure substantially, inserting a portion of a dowel bar into each of the sleeves when the concrete of the first slab is substantially cured, and leaving a Second portion of each dowel uncovered by the first slab. The method further comprises forming a second concrete slab adjacent to the first slab by applying concrete onto the second portions of the dowel bars.

It is an object of the present invention to provide a reinforced joint between adjacent concrete slabs wherein the adjacent slabs will remain in alignment.

It is an object of the present invention to provide a reinforced joint between adjacent concrete slabs wherein steel dowels are used to reinforce the joint between adjacent concrete slabs.

It is an object of the present invention to provide a reinforced joint between adjacent concrete slabs wherein the steel dowels are inserted into adjacent slabs at the same time so a dowel is not projecting from one of the slabs for a prolonged period of time while the second slab is being poured, thereby causing a construction hazard.

These and other objects and advantages of the present invention will be fully apparent from the following description, when taken in connection with the annexed drawings.

DESCRIPTION OF THE PREFERRED EMBODIMENT

Figure 1:
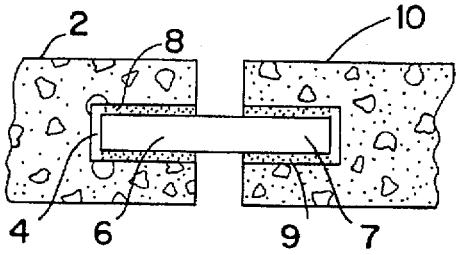
FIG. 1 PRIOR ART
FIG. 1 is a cross-sectional view illustrating a doweled concrete surface constructed according to one prior art construction method.

FIG. 1 illustrates a doweled concrete surface constructed according to one prior art method. Under this first prior art method, concrete is first poured to form a slab 2. When the concrete is cured, a horizontal hole 4 is drilled into a vertical side face of the slab 2. A dowel bar 6, with epoxy 8 applied to one end thereof, is then inserted into the hole 4. The other end 7 of dowel bar 6 is then covered with a lubricant 9. After end 7 of the dowel bar 6 is greased or otherwise lubricated, concrete is poured to form the adjacent slab 10.

Figure 2:
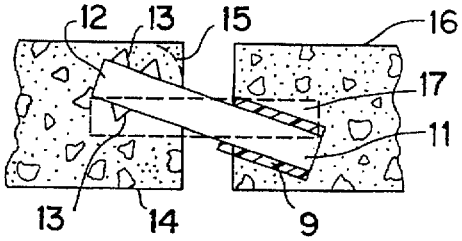
FIG. 2 PRIOR ART
FIG. 2 is a cross-sectional view illustrating a doweled concrete surface constructed according to another prior art construction method.

FIG. 2 illustrates a doweled concrete joint constructed under another prior art method. Under this second prior art method, concrete is first poured to form a slab 14. While the concrete of the slab 14 is still in a plastic state, a dowel bar inserting machine (not shown) is used to vibrate a dowel bar 12 into the slab 14. When the dowel bar 12 is first inserted into the still plastic concrete, it will be in the position shown by the dotted lines 17 in FIG. 2. As the slab 14 cures, the dowel bar 12 will tend to drop on one end 11 because the dowel bar is made from steel which is heavier than the still wet concrete. Also when the dowel bar sags, it also causes the top surface (shown in dotted lines at 15) to sag or slump at the edge causing a low spot. If this condition is not corrected or if corrected by hand finishing may result in the possibility of irregularities both in the elevation of the surface and the consolidation of the concrete. When the slab 14 is completely cured, the free end 11 of the dowel bar 12 is lubricated at 9, and an adjacent slab 16 is poured covering the end 11 of the dowel bar.

The above described prior art methods suffer several disadvantages. For example, because of time needed for drilling the hole 4 and applying the epoxy 8, the first prior art method is generally a lengthy process. There are also deviations in hole depth and diameter from timing, alignment, and wear. This causes an unequal amount of epoxy needed for each hole, which could result in a poor joint between the dowel and the concrete slab. Also, the drilling process can cause minute fractures in the concrete, thereby weakening and shortening the life of the slab. On the other hand, a doweled joint constructed according to the second prior art method generally has consolidations (voids) 13 which appear around the dowel bar 120. Moreover, under the second prior art method, because the dowel bar 12 is suspended in the concrete of slab 14 while it is still plastic, the weight of the dowel bar 12 would cause it to sag and attain a final position as exaggeratedly shown by the solid lines in FIG. 2.

Another disadvantage of the above second prior art method is that, between the time the dowel bar 12 is inserted into the slab 14 and the time the concrete of the slab 16 is poured, the exposed end 11 of dowel bar 12 would protrude from slab 14 becoming an obstacle and a hazard to workers and equipment on the construction site.

Figure 3:
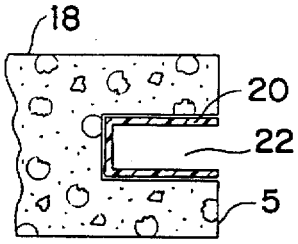
FIG. 3 a cross-sectional view illustrating a slab utilizing the present invention.

FIG. 3 illustrates a concrete slab 18 wherein the present invention is embodied. The slab 18 has a plurality of sleeves 20, inserted into the vertical face 5 of slab 18. The sleeves 20 can be made from any material that is lighter than the concrete in its plastic state, however it is preferred to make the sleeves from a heat shrink plastic for a reason to be described later.

Figure 7:
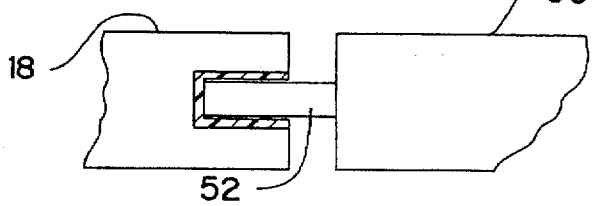
FIG. 7 is a schematic showing one apparatus for carrying out the method of the present invention.

In constructing the slab 18, concrete is placed on grade using a slipform paver and the sleeves are inserted into the vertical face(s) using a conventional dowel bar inserter attached to the paver 50, shown in FIG. 7. Any dowel bar inserter, or similar device, may be used for this purpose such as, but not limited to, those disclosed in U.S. Pat. Nos. 4,433,936, 4,493,584, or 4,688,963 and the disclosure of each of these patents is incorporated herein by reference. A sleeve 20 is inserted by placing it on the tip of a rod 52 extending from the dowel bar inserter machine 50, then the dowel bar inserter machine vibrates the rod and, at the same time urges the sleeve 20 into the slab 18. When the sleeve 20 has penetrated to a predetermined position, the rod is retracted, leaving the sleeve 20 in the concrete slab 18.

Adjacent ones of the plurality of sleeves 20 in the concrete slab 18 are separated by a predetermined spacing. For example, for a runway or similar structure, a sleeve 20 is preferably inserted every 16" to 18" along the entire face 5 of the slab 18.

After the sleeves 20 are inserted, the concrete of the slab 18 is allowed to cure and set. Because the sleeves 20 are lighter than the dowel bars, they will not sag even when the concrete is wet. When the concrete sets and cures, it rigidly and securely holds the sleeves 20 in place within the slab 18, providing a number of cavities 22 along the face 5 of the slab 18.

Figure 4:
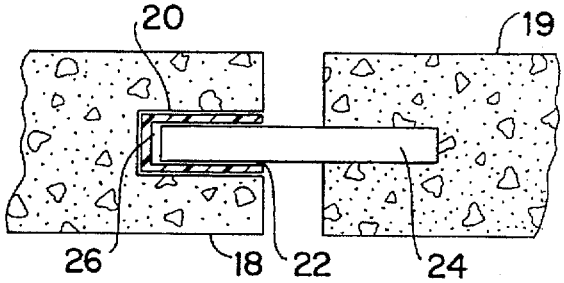
FIG. 4 is a cross-sectional view illustrating two adjacent slabs and a doweled joint constructed utilizing the present invention.

Referring to FIG. 4, when the concrete of the slab 18 is cured completely and when construction of the adjacent slab is ready to begin, dowel bars 24, preferably made of ASTM A-36 steel and with about 1¼" to 1½" inches in diameter, are then inserted into the sleeves 20. A space 26 is left between the end of each dowel bar 24 and the bottom of the corresponding sleeve 20 to provide room for thermal expansion of the dowel bar 24.

Each of the sleeves 20 is preferably made of heat-shrink rigid plastic. The reason for the heat shrink is for spot-checking of consolidation (voids). The sleeve can be shrunk and removed to allow physical inspection of the consolidation around the sleeve. If necessary, after inspection, a dowel may be epoxied into the hole so the need for drilling is completely eliminated. One of the advantages of the present invention is that the provision of the sleeves 20 obviates the need for lubrication of the dowel bar 24.

As discussed above, in prior art construction of doweled concrete surfaces such as the second prior art method described above, the dowel bars are in place while the concrete is being cured and set, the exposed ends of the dowel bars usually become obstacles and a hazard to equipment and people working on the construction site. One of the advantages of the present invention over the prior art methods is that the dowel bars can be inserted into the slab after it is substantially cured and when construction of the adjacent stab is ready to begin.

Figure 5:
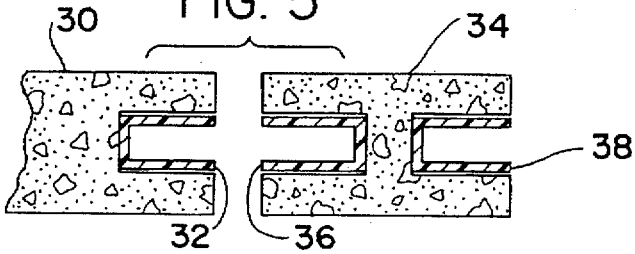
FIGS. 5 and 6 are cross-sectional views illustrating how a doweled concrete surface can be constructed according to the present invention.
Figure 6:
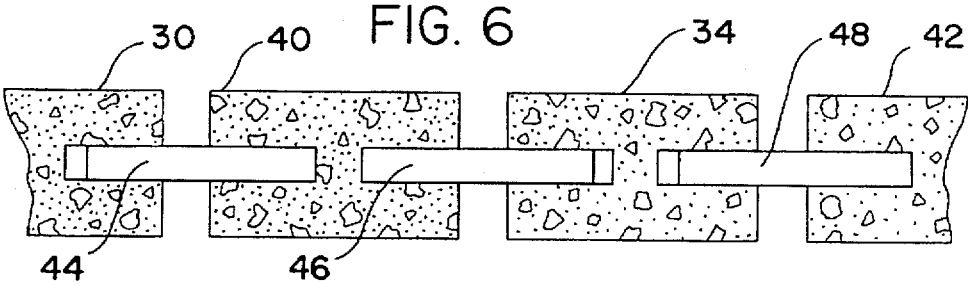

FIGS. 5 and 6 illustrate how a surface, such as a runway, can be constructed using the present invention. Referring to FIG. 5, in constructing the concrete surface, a first group of slabs, comprising slab 30 with sleeves 32, and slab 34 with sleeves 36 and 38, are first constructed. The first group of slabs, 30 and 34, are then left to cure. Before construction of other slabs is ready to commence, dowel bars are not inserted into the sleeves 32, 36 and 38, therefore there will be no dowel bars sticking out of the slabs to form a potential hazard to people or equipment.

Referring to FIG. 6, when slabs 30 and 34 are completely cured, a second group of slabs, comprising slab 40 and slab 42, can then be constructed. Immediately before concrete is pored to form slabs 40 and 42, dowel bar 44 is inserted into sleeve 32, and dowel bar 46 is inserted into sleeve 36 and dowel bar 48 is inserted into sleeve 38 (it should be noted that the sleeves 32, 36, and 38 have been removed from FIG. 6 for purposes of clarity). Typically, each of dowel bars 44, 46 and 48 is inserted by a length equal to half of its total length. The depth of each of sleeves 32, 36 and 38 is equal to half the length of a dowel bar plus a predetermined space provided to accommodate thermal expansion of the corresponding dowel bar.

After dowel bars 44, 46 and 48 are inserted, concrete is poured onto the exposed ends of the dowel bars 44, 46 and 48 to form slabs 40 and 42. When the concrete of slabs 40 and 42 is set and cured, they will securely holds the ends of the dowel bars 44, 46 and 48 in place. Also, it should be noted that the space between the sleeves and the concrete slab has been exaggerated in FIGS. 3 and 5 for purposes of clarity. In actual use the sleeves will be in intimate contact with the respective slabs. Also, the space between adjacent slabs in FIGS. 1, 2, 4, and 6 has been exaggerated for the same reason.

Although the doweled construction joints and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A method for constructing a concrete surface, comprising the steps of:

forming a first concrete slab having a top surface and at least one side surface;

inserting a plurality of sleeve means through said at least one side surface while said first concrete slab is in a plastic state;

allowing said first concrete slab to harden;

inserting a dowel bar into each of said sleeve means after said first concrete slab has hardened, with a first portion of each said dowel bar being inserted into said first concrete slab and a second portion of each said dowel bar protruding from said first concrete slab; and forming a second concrete slab by applying concrete onto said second portion of each said dowel bar.

2. The method as claimed in claim 1, including spacing each of said sleeve means approximately 16 to 18 inches apart.

3. The method as claimed in claim 1, wherein the step of inserting said sleeve means comprises the step of inserting a plurality of plastic sleeve means into said first slab.

4. The method as claimed in claim 1, wherein the step of inserting said sleeve means comprises the step of inserting a plurality of sleeve means, each with a diameter of at least one inch into said first slab.

5. The method as claimed in claim 1, wherein the step of inserting a dowel bar into each of said sleeve means is performed immediately before said step of forming said second concrete slab.

6. The method as claimed in claim 1, wherein the step of inserting said sleeve means comprises the steps of:

placing each of said sleeve means on a rod extending from a dowel bar inserter machine;

vibrating said rod; and at the same time;

urging said rod toward said first slab.

7. The method as claimed in claim 6, which includes the further step of removing said rod from each of said sleeve means after each said sleeve means has been positioned entirely within said first slab.

8. A concrete surface made by the method as claimed in claim 1.

* * * * *